US006113385A

United States Patent [19]

Mifune et al.

[11] Patent Number: 6,113,385

[45] Date of Patent: Sep. 5, 2000

[54] COMBUSTION WICK FOR LIQUID FUEL COMBUSTION APPLIANCES

[75] Inventors: Hideo Mifune; Yasuaki Nakamura; Takashi Tsukamoto, all of Shizuoka-ken, Japan

[73] Assignee: Tokai Corporation, Shizuoka-ken, Japan

[21] Appl. No.: 09/077,945

[22] PCT Filed: Oct. 22, 1997

[86] PCT No.: PCT/JP97/03805

§ 371 Date: Jun. 5, 1998

§ 102(e) Date: Jun. 5, 1998

[87] PCT Pub. No.: WO98/17949

PCT Pub. Date: Apr. 30, 1998

[30] Foreign Application Priority Data

Oct. 24, 1996 [JP] Japan ..... 8-282161

[51] Int. Cl.[7] ..... F23D 14/28

[52] U.S. Cl. ..... 431/344; 431/323; 431/325; 431/298; 126/96

[58] Field of Search ..... 431/344, 320, 431/322, 323, 325, 153, 298, 301, 326, 327, 328, 152, 144; 126/96, 45; 44/519; 222/187

[56] References Cited

U.S. PATENT DOCUMENTS

| | | | |
|---|---|---|---|
| 184,434 | 11/1876 | Sanford | 431/325 |
| 2,576,042 | 11/1951 | Reilly | 431/325 |
| 2,774,235 | 12/1956 | Ruetz | 431/325 |
| 3,236,072 | 2/1966 | Goldszmid | 431/325 |
| 3,262,290 | 7/1966 | Huber | 431/325 |
| 3,759,658 | 9/1973 | Mifune et al. | 431/255 |
| 4,126,408 | 11/1978 | Cox | 321/325 |
| 4,416,616 | 11/1983 | Shimizu et al. | 431/325 |
| 4,518,347 | 5/1985 | Sonetaka et al. | 431/325 |
| 4,878,832 | 11/1989 | Lynch | 431/325 |

FOREIGN PATENT DOCUMENTS

| | | |
|---|---|---|
| 845639 | 8/1960 | European Pat. Off. . |
| 58160712 | 9/1983 | European Pat. Off. . |
| 378827 | 7/1960 | Germany . |

OTHER PUBLICATIONS

European Search Report mailed Nov. 4, 1999 in application No. EP 97 90 9572.

*Primary Examiner*—Ira S. Lazarus
*Assistant Examiner*—Josiah C. Cocks
*Attorney, Agent, or Firm*—Baker Botts L.L.P.

[57] ABSTRACT

In a combustion appliance provided with a combustion wick for sucking up a liquid fuel by the utilization of capillarity and burning it, the combustion wick is constituted, such that a flame length in accordance with the application of the combustion appliance can be obtained, such that little change in fuel feed rate may occur due to a change in amount of residual fuel, and such that the flame length may not change. The combustion wick (6) comprises a sucking section (61) for sucking up the liquid fuel and a heat-resistant burning section (62), which are made from different materials and connected to each other.

2 Claims, 5 Drawing Sheets

COMBUSTION WICK FOR LIQUID FUEL COMBUSTION APPLIANCES

TECHNICAL FIELD

This invention relates to a combustion wick for sucking up a liquid fuel and burning it in a combustion appliance for a liquid fuel, such as a lighter using an alcohol fuel, or the like.

This invention particularly relates to a constitution of a combustion wick for obtaining a desired state of combustion in combustion appliances, such as lighters for smoker's requisites, other types of lighters, torches, lanterns, and other types of illumination devices, in which liquid fuels, such as alcohols, benzine types of hydrocarbons, or petroleum types of hydrocarbons.

BACKGROUND ART

Ordinarily, as fuels in combustion appliances, such as lighters for smoker's requisites, other types of lighters, torches, and illumination devices, alcohol fuels, such as ethyl alcohol, petroleum benzine types of benzine fuels, or liquefied gas fuels, such as butane gas or propane gas, have heretofore been utilized.

The performances, the levels of convenience of handling, and the design structures of the combustion appliances vary in accordance with the kinds of the fuels used, and the fuels have their own features. For example, in cases where the liquefied gas fuels are used as the liquid fuels, since the liquefied gas fuels have a high gas pressure at temperatures falling within the range, in which the combustion appliance is used, the vessel for storing the fuels must have a pressure-resistant structure. Also, the flame length varies in accordance with variations in gas pressure. In particular, the liquefied gas fuels have the characteristics such that their gas pressures markedly vary logarithmically with respect to temperatures, and therefore the problems occur in that the flame length changes markedly, depending upon temperatures. In order for the change in flame length to be reduced, a special design countermeasure for carrying out temperature compensation for a fuel feeding mechanism of the combustion appliance must be taken. Therefore, the structure cannot be kept simple, and the cost cannot be kept low.

As for the liquid fuels, such as the alcohol fuels, they are liquids at normal temperatures and have comparatively low vapor pressures. Therefore, the fuel storing section need not have a pressure-resistant structure. Accordingly, the structure of the combustion appliance can be kept simple, and the cost can be kept comparatively low. In the combustion appliances for the liquid fuels, ordinarily, as means for feeding the liquid fuel from the fuel storing section to the burning section, a combustion wick, which sucks up the liquid fuel with the capillarity through open pores or through minute spaces formed between thin fibers in a fiber bundle and by the utilization of the surface tension of liquid fuel and allows the liquid fuel to burn at a top end portion of the wick, has heretofore been used.

Specifically, in the combustion wick, the liquid fuel is sucked up by the utilization of a string-like wick formed by twisting fibers, a bundle of glass fibers, a wick formed by bundling glass fibers with cotton threads and interweaving thin metal wires for preventing the bundle from becoming loose, or the like. The lower end portion of the combustion wick has the functions for sucking up the liquid fuel, and the sucked-up fuel is burned at the top end portion of the wick.

However, with the combustion wick, in which the fuel sucking portion and the burning portion are made from the same material and formed as an integral body, both of the requirement for the performance for sucking up the liquid fuel from the fuel storing section and the requirement for the combustion performance cannot be satisfied sufficiently.

For example, a combustion wick, in which the sucking portion is made from the same material as the heat-resistant material of the burning portion and the two portions are formed as an integral body, may be used. Also, the lower portion of the combustion wick may be inserted into the fuel storing section having been injected with the liquid fuel, and the liquid fuel may be lighted and burned at the upper portion of the combustion wick. In such cases, when the amount of the fuel in the fuel storing section becomes small due to the use of the fuel for the burning at the burning portion and the distance, over which the fuel is to be sucked up from the fuel storing section to the burning portion, becomes long, the rate of the sucking of the fuel through the sucking portion becomes low, and the rate of fuel feeding to the burning portion becomes low. As a result, the flame length becomes short. However, if the thickness of the combustion wick is set to be large such that the sucking performance of the sucking portion may be enhanced, the flame length will become long, or the flame thickness will become large. Thus the combustion wick has the problems in that a combustion flame having characteristics suitable for the application of the combustion appliance cannot be obtained.

In cases where the combustion wick is made from a material, which has good sucking performance but has a low heat resistance, the problems occur in that adverse effects of heat during the combustion occur quickly on the characteristics of the combustion wick. As a result, the flame length varies, and good durability cannot be obtained. Conversely, with a combustion wick which has good combustion characteristics but has insufficient sucking performance as described above, a stable flame length cannot be obtained.

Further, in the cases of lighters for smoker's requisites, and the like, it is often desired that the combustion flame can be rendered small or can be extinguished after the combustion has been continued for a predetermined length of time. In cases where a combustion wick having such characteristics is to be constituted, it is difficult for the combustion wick, in which the sucking portion and the burning portion are made from the same material and formed as an integral body, to satisfy both of the requirement for the fuel sucking characteristics and the requirement for the combustion characteristics.

In view of the above circumstances, the object of the present invention is to provide a combustion wick in a combustion appliance for a liquid fuel, which combustion wick has combustion characteristics appropriate for the application of the combustion appliance.

DISCLOSURE OF INVENTION

A combustion wick in a combustion appliance for a liquid fuel in accordance with the present invention, which solves the problems described above, is characterized by making a sucking section for sucking up a liquid fuel and a heat-resistant burning section from different materials, and connecting the sucking section and the burning section to each other.

During the combustion of the liquid fuel with the combustion wick in accordance with the present invention, the liquid fuel, which is stored in a fuel storing section, is sucked up through the sucking section and is thus fed to the burning section. The sucking section is constituted of a material having the sucking characteristics such that, even if the amount of the fuel remaining in the fuel storing section varies, the rate, at which the fuel is fed to the burning section, may be constant. The burning section is constituted of a heat-resistant material, which is not lost due to the combustion. Also, the burning section is formed such that a required flame length and a required flame shape may be obtained. With the combination of the sucking section and the burning section, the combustion with a stable flame length and good durability are achieved. In particular, in cases where the fuel feed rate through the sucking section is set at a value higher than the fuel burning rate at the burning section, continuous combustion can be carried out reliably.

The present invention also provides a combustion wick in a combustion appliance for a liquid fuel, wherein a sucking section for sucking up a liquid fuel and a heat-resistant burning section are made from different materials and connected to each other, and a rate, at which the liquid fuel is fed through the sucking section to the burning section, is set at a value lower than a fuel burning rate at the burning section.

With the last-described combustion wick in accordance with the present invention, the fuel feed rate through the sucking section is set to be lower than the fuel burning rate at the burning section. Therefore, when the liquid fuel, which has been sucked up through the sucking section to the vicinity of the burning section in the extinguished state, is lighted and burned for a predetermined length of time, insufficiency in fuel occurs at the burning section due to the low fuel feed rate through the sucking section. As a result, the flame length becomes short, or the fire is extinguished. Thus the combustion wick has the characteristics such that the combustion for only a predetermined length of time can be carried out. Accordingly, the combustion wick can be utilized as a combustion wick in combustion appliances, such as lighters for smokers requisites.

The burning section should preferably be constituted of heat-resistant fibers, such as glass fibers, ceramic fibers, or carbon fibers, or should preferably be constituted of a porous glass material having open cells or a sintered porous ceramic material having open cells. The sucking section should preferably be made from a sintered material, which is obtained by sintering polyethylene powder, or the like, or should preferably be made from a fiber material, which has been bundled or which has been formed into a predetermined shape by use of an adhesive agent. With the above-enumerated materials, the burning section, which has a heat resistance and is capable of carrying out stable combustion, can be obtained. Also, the sucking section, which exhibits little fluctuation in fuel feed rate with respect to a change in amount of residual fuel, can be obtained.

Also, from the point of view of the production process, or the like, the sucking section and the burning section should preferably be combined with each other by a cylindrical connecting member located around an outer periphery of a region, at which an end of the sucking section and an end of the burning section are connected with each other. Further, in order for stable combustion to be achieved, a fuel reservoir should preferably be located in the vicinity of a position, at which the sucking section and the burning section are combined with each other.

The liquid fuel may be an alcohol type of fuel, such as a fuel containing, as a principal constituent, a lower monohydric alcohol selected from the group consisting of methyl alcohol, ethyl alcohol, and propyl alcohol, and containing a saturated hydrocarbon, such as hexane or heptane, for coloring the flame. Alternatively, a benzine type of hydrocarbon, a petroleum type of hydrocarbon, or the like, may be employed as the liquid fuel.

With the combustion wick in accordance with the present invention, the sucking section and the burning section are made from different materials and connected to each other. Therefore, the combustion wick having the combustion performance and the sucking performance, which are appropriate for the characteristics required for each of combustion appliances, can be constituted easily. For example, the combustion wick can be constituted such that it may be appropriate for long-time continuous combustion, or such that it may be appropriate for a mode of combustion, in which the flame length is to be rendered small or the fire is to be extinguished after the combustion has been continued for a predetermined length of time.

Specifically, with the combustion wick in accordance with the present invention, the combustion wick is divided into the burning section, which is located at the top end of the wick, and the sucking section, which sucks up the fuel and feeds it to the burning section. The sucking section and the burning section are made from different materials and connected with each other. Therefore, the fuel can be fed to the burning section, such that a necessary flame shape and a necessary flame length can be formed. Also, the fuel can be fed to the burning section, such that the combustion of the combustion flame can be continued reliably, or such that the combustion flame may be produced only for a predetermined length of time.

BEST MODE OF CARRYING OUT THE INVENTION

Embodiments of the combustion wick in accordance with the present invention will be described hereinbelow with reference to the accompanying drawings.

<First embodiment>

Figure 1:
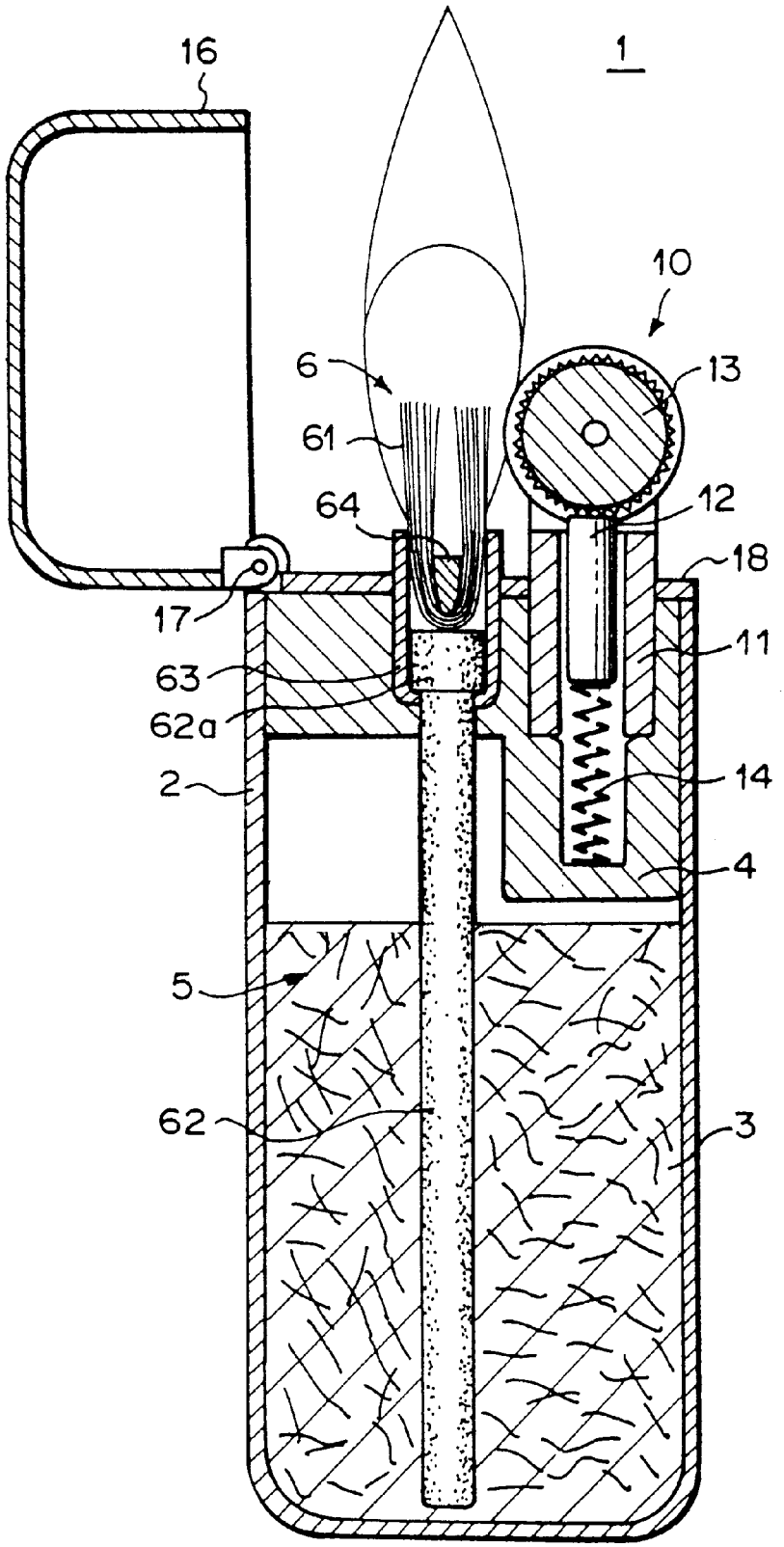
FIG. 1 is a schematic sectional view showing an example of a combustion appliance for a liquid fuel, in which a first embodiment of the combustion wick in accordance with the present invention is employed, and which takes on the form of a lighter.

FIG. 1 shows a schematic sectional structure of an example of a combustion appliance, in which a first embodiment of the combustion wick in accordance with the present invention is employed, and which takes on the form of a lighter.

A combustion wick 6 comprises a burning section 61 at an upper part and a sucking section 62 at a lower part, which are made from different materials and as separate portions. The burning section 61 and the sucking section 62 are combined with each other by a connecting member 63, such that a lower end of the burning section 61 and an upper end of the sucking section 62 may be in contact with each other.

The burning section 61 is formed by bundling glass fiber threads, bending the bundle at its intermediate part, inserting the bent portion of the bundle into a cylindrical connecting member 63 made from a metal, pushing a wedge-like securing member 64 into the space, which is defined by the bent portion of the bundle having been inserted into the connecting member 63, and thereby securing the bent portion of the bundle. The sucking section 62 is formed into a rod-like shape having a head 62*a* of an increased diameter by sintering polyethylene powder in a mold. The head 62*a* is inserted into a lower portion of the connecting member 63 and brought into contact with the lower end of the burning section 61. In this state, the lower end portion of the connecting member 63 is caulked, and the burning section 61 and the sucking section 62 are thereby combined with each other. The combustion wick 6 is constituted in this manner.

Alternatively, the lower end portion of the connecting member 63 may be constricted previously into a small diameter. The leg of the sucking section 62 may then be inserted into the connecting member 63, and the head 62*a* of the sucking section 62 may be engaged with the constricted portion of the connecting member 63. Thereafter, the bent portion of the burning section 61 may be inserted into the connecting member 63, and the securing member 64 may be pushed into the space defined by the bent portion of the burning section 61. In this manner, the burning section 61 and the sucking section 62 may be secured to each other such that they may be in contact with each other.

With the combustion wick 6 described above, the fuel burning rate, the flame shape, and the flame length are set by the thickness, the number, and the length of the glass fibers constituting the burning section 61. As for the sucking section 62, the state of formation of internal pores depends upon the thickness of the sucking section 62, the particle diameter of the sintered polyethylene powder, the sintering density, and the like. The fuel sucking and feeding characteristics of the sucking section 62 are set by these factors. The head 62*a* of the sucking section 62 has the increased diameter and a large volume and constitutes a fuel reservoir for retaining the liquid fuel. The fuel reservoir serves to stabilize the combustion.

For example, in cases where the combustion wick 6 is the one incorporated in lighters for smoker's requisites, the burning section 61 is made from glass fibers having a thickness of 6 $\mu$m, a fiber density (i.e., a weight per unit area) of 150 mg/cm$^3$, and a length of 20 mm. A bundle of the glass fibers is bent at its middle part, and a bent bundle having an outer diameter of 3 mm and a length of 10 mm is thereby obtained. The bent bundle is then inserted into the connecting member 63, such that the bent bundle may be projected by a length of 5 mm from the top end of the connecting member 63. The sucking section 62 is formed by introducing the polyethylene powder, which is a mixture of particles having particle sizes of 70 to 200 mesh and has an average particle size of 140 mesh, into a mold, and sintering the polyethylene powder at 170° C. for 10 minutes. The sucking section 62 is formed, such that the head 62*a* may have an outer diameter of 4.2 mm and a length of 3 mm, and the leg under the head 62*a* may have an outer diameter of 4 mm and a length of 37 mm.

The combustion wick 6 having the constitution described above is incorporated in a lighter 1 serving as a combustion appliance. The sucking section 62 is inserted into a fuel storing section 5. The sucking section 62 sucks up the liquid fuel from the fuel storing section 5 and feeds it to the burning section 61. The sucked liquid fuel is lighted at the top end portion of the burning section 61 by a lighting member 10 and burned. In cases where the combustion is to be carried out continuously, the combustion wick 6 is set so as to have the characteristics such that the fuel feed rate through the sucking section 62 may be higher than the fuel burning rate at the burning section 61. In this manner, the combustion at the burning section 61 can be continued such that the flame shape and the flame length may not change (refer to Experimental Example 1, which will be described later).

As described above, the burning section 61 and the sucking section 62 are made from different materials. Therefore, the burning section 61 can be designed in accordance with a desired flame size and a desired flame shape. Also, the sucking section 62 can be designed such that the sucking performance in accordance with the fuel burning rate at the burning section 61 can be obtained.

In lieu of the glass fibers, the burning section 61 of the combustion wick 6 described above may be made from ceramic fibers or carbon fibers as the heat-resistant fibers. By way of example, ceramic fibers having a thickness of 2.8 $\mu$m may be formed from a raw material, which principally contains alumina and silica, and a small amount of an organic binder may be added to the ceramic fibers. The thus obtained ceramic fibers may be formed into a predetermined shape, such that the packing density may be 200 mg/cm$^3$.

The lighter 1 has the structure described below. Specifically, the lighter 1 is provided with a bottomed case-like tank 2. A fiber material 3 (wadding) is inserted into the tank 2. An upper cover 4 is secured to the upper part of the tank 2. In this manner, the fuel storing section 5 for storing the liquid fuel is formed.

By way of example, the tank 2 is constituted of a molded product of polypropylene and has an internal volume of 5 $cm^3$. As the fiber material 3, polypropylene fibers having a thickness of 1 to 2 denier are pushed at a density of 0.1 $g/cm^3$ into the tank 2. Also, 4 cc of the liquid fuel is injected into the tank 2, the fiber material 3 is thus impregnated with the liquid fuel, and the liquid fuel is thereby stored in the tank 2. As the liquid fuel, a mixed liquid fuel, which contains 95 wt % of ethyl alcohol and 5 wt % of n-hexane, is employed.

The combustion wick 6 is inserted vertically through a center portion of the upper cover 4 and into the tank 2. A portion of the connecting member 63 is secured to the upper cover 4. A lower end portion of the sucking section 62 of the combustion wick 6 is brought into contact with the fiber material 3, which is contained in the tank 2. By the utilization of capillarity, the sucking section 62 sucks up the liquid fuel, which is contained in the fiber material 3. The thus sucked-up fuel is lighted at the burning section 61 of the combustion wick 6 and is burned with a flame being produced. The length of projection of the burning section 61 from the connecting member 63 is adjusted to be approximately 5 mm, such that the flame length may be 30 mm.

The lighting member 10 is fitted into the upper cover 4 such that the lighting member 10 may stand facing the top end portion of the burning section 61 of the combustion wick 6. The lighting member 10 comprises a bracket 11, which is secured to the upper cover 4, and an ignition stone 12, which is inserted into the bracket 11 such that it can move vertically. The lighting member 10 also comprises a rotatable file 13, which is located at the upper end of the bracket 11, and a stone pushing spring 14, which pushes the ignition stone 12 such that the end of the ignition stone 12 may be pushed against the circumferential surface of the rotatable file 13 by the urging force of the stone pushing spring 14. When the rotatable file 13 is rotated, sparks are thrown out from the ignition stone 12 toward the combustion wick 6.

An openable cap 16 covers the region above the combustion wick 6 and the lighting member 10. The cap 16 is pivotably supported for rotation by a pin 17 on one end portion of the upper surface of the upper cover 4. The portion, at which the tank 2 or the upper cover 4 comes into contact with the cap 16, is provided with a sealing material 18, such that the portion may be hermetically sealed and prevents the liquid fuel from evaporating.

<Second embodiment>

Figure 2:
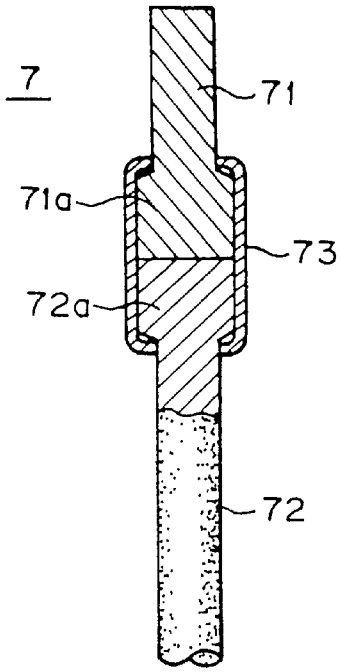
FIG. 2 is a schematic sectional view showing a second embodiment of the combustion wick in accordance with the present invention.

As illustrated in FIG. 2, a combustion wick 7 is provided with a burning section 71, which is constituted of a sintered material. The combustion wick 7 comprises the burning section 71 at an upper part and a sucking section 72 at a lower part, which are made from different materials and as separate portions. The burning section 71 and the sucking section 72 are combined with each other by a connecting member 73, such that a lower end of the burning section 71 and an upper end of the sucking section 72 may be in contact with each other.

The burning section 71 is made from a sintered porous glass material or a sintered porous ceramic material and contains open cells (capillary paths) therein. The lower end portion of the burning section 71 is formed as a securing portion 71*a*, which has a step-like part and is thicker than the upper end portion of the burning section 71. The sucking section 72 is made from a fiber material, which has been formed into a rod-like shape by use of an adhesive agent, a fiber material, which has been bundled without an adhesive agent being used, or a sintered material, which is obtained from the sintering of polyethylene powder described above. The upper end portion of the sucking section 72 is formed as a head 72*a*, which has a step-like part and is thicker than the lower end portion of the sucking section 72. The securing portion 71*a* of the burning section 71 and the head 72*a* of the sucking section 72 are connected to each other by caulking the connecting member 73, and the combustion wick 7 is thereby formed as an integral body. Also, the portion inside of the connecting member 73 has an increased volume and serves as a fuel reservoir for retaining the liquid fuel.

In order for the combustion wick 7 to be produced, one end portion of the connecting member 73 is firstly constricted. The sucking section 72 (or the burning section 71) is then inserted into the connecting member 73, and its thick end portion is engaged with the sintered porous ceramic material. Thereafter, the thick end portion of the burning section 71 (or the sucking section 72) is inserted into the opposite side of the connecting member 73, and the other end portion of the connecting member 73 is caulked. In this manner, the burning section 71 and the sucking section 72 are connected to each other.

<Third embodiment>

Figure 3A:
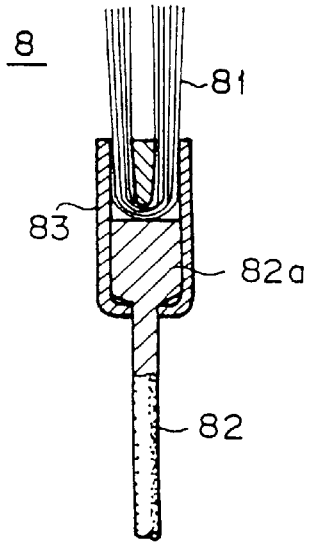
FIGS. 3A and 3B are schematic sectional views showing two kinds of wicks in a third embodiment of the combustion wick in accordance with the present invention.
Figure 3B:
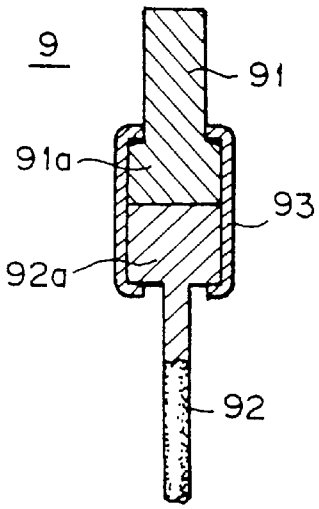

This embodiment is constituted as illustrated in FIG. 3A or FIG. 3B, such that the flame may become small or the fire may be extinguished after the combustion has been continued for a predetermined length of time.

A combustion wick 8 illustrated in FIG. 3A is constituted approximately in the same manner as that in the combustion wick 6 shown in FIG. 1. A burning section 81, which is made from glass fibers, and a sucking section 82, which is made from a sintered material, are connected to each other by a connecting member 83. A portion of the sucking section 82, which portion is lower than a head 82*a* of the sucking section 82, has a smaller cross-sectional area than that of the head 82*a*, and the fuel sucking rate is thereby set to be lower than the fuel burning rate at the burning section 81. Also, the head 82*a* of the sucking section 82 has an increased cross-sectional area and serves as a fuel reservoir, such that a necessary length of continuous combustion time can be obtained.

A combustion wick 9 illustrated in FIG. 3B is constituted approximately in the same manner as that in the combustion wick 7 shown in FIG. 2. A burning section 91, which is made from a sintered porous glass or ceramic material, and a sucking section 92, which is made from a sintered material or a fiber material, are connected to each other by a connecting member 93. A portion of the sucking section 92, which portion is lower than a head 92*a* of the sucking section 92, has a smaller cross-sectional area than that of the head 92*a*, and the fuel sucking rate is thereby set to be lower than the fuel burning rate at the burning section 91. Also, the head 92*a* of the sucking section 92 and a securing portion 91*a* of the burning section 91, the two portions being located within the connecting member 93, have an increased cross-sectional area and serve as a fuel reservoir for obtaining a necessary length of continuous combustion time.

With the combustion wick 8 or 9 described above, when a predetermined combustion time corresponding to the amount of the fuel retained in the fuel reservoir has elapsed, the amount of the fuel fed through the sucking section 82 or 92 to the burning section 81 or 91 becomes insufficient, and the combustion at the burning section 81 or 91 cannot be continued any more. Therefore, the flame becomes small or the fire is extinguished (refer to Experimental Example 2, which will be described later).

By way of example, as the liquid fuel injected into the fuel storing section 5, it is possible to employ an alcohol fuel, which contains, as a principal constituent, an alcohol, such as a lower monohydric alcohol selected from the group consisting of methyl alcohol, ethyl alcohol, and propyl alcohol, and contains at least one kind of hydrocarbon compound having approximately the same boiling point as that of the principal constituent, such as a saturated hydrocarbon selected from the group consisting of hexane, heptane, octane, nonane, cyclohexadiene, and cycloheptene. With an alcohol alone, a colorless combustion flame is produced. By the addition of the saturated hydrocarbon described above, the top end portion of the combustion flame is imparted with a yellow-orange color due to high-temperature light emission of liberated carbon.

It is also possible to employ a liquid fuel, which is composed of at least one kind of compound selected from the group consisting of heptane, octane, and nonane. A liquid fuel composed of a benzine type of hydrocarbon may also be employed.

Examples of the combustion appliances include lighters for smoker's requisites, other types of lighters, torches, lanterns, and other types of illumination devices.

In the experimental examples described below, the lighter 1, in which the combustion wick described above was incorporated, was used, a predetermined amount of an alcohol type of liquid fuel was injected into the fuel storing section 5, and a change in flame length during the combustion was measured.

EXPERIMENTAL EXAMPLE 1

The experiments were carried out by using the first embodiment of the combustion wick in accordance with the present invention in order to find the relationship between the continuous combustion time and the flame length was measured with respect to a change in amount of (residual) liquid fuel in the fuel storing section. Specifically, the sucking performance of the sucking section was evaluated with respect to an increase in sucking distance occurring when the amount of residual fuel became small.

Figure 4:
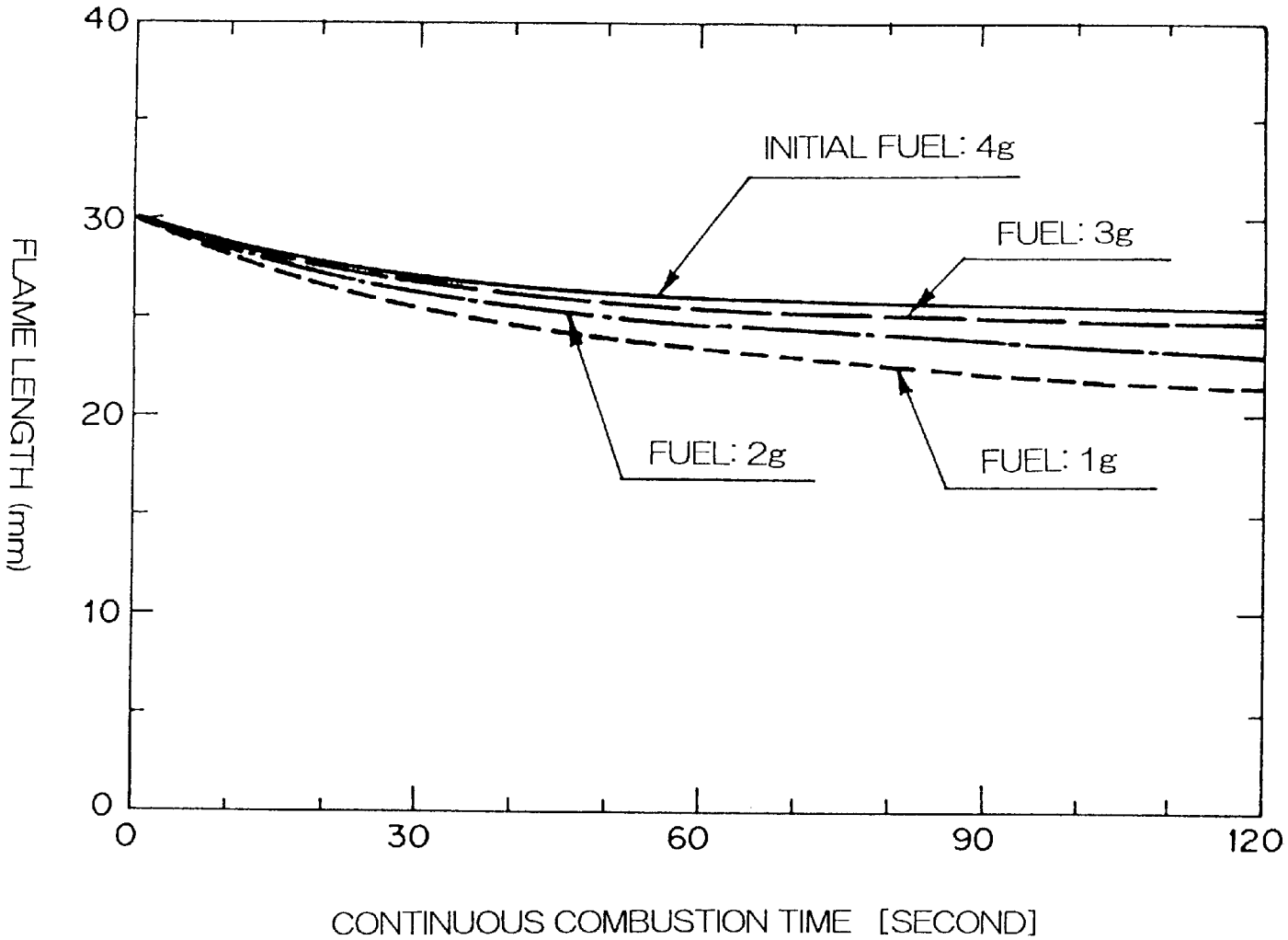
FIG. 4 is a graph showing the results of a combustion test carried out in Experimental Example 1 by using the lighter shown in FIG. 1.

The results shown in FIG. 4 were obtained. The initial flame length was set at 30 mm. There was the tendency for the flame length to become slightly small with the passage of the combustion time after the lighting. Also, in cases where the amount of initial fuel was small, there was the tendency for the decrease in flame length to become large. However, the effects of the difference in amount of initial fuel did not occur as a large change in flame length. It was found that a fuel feed rate corresponding to the fuel burning rate could be obtained by virtue of good fuel sucking performance of the sucking section.

In a comparative example carried out with respect to the experiments described above, the results shown in FIG. 5 were obtained. In the comparative example, a combustion wick, which was formed by bundling cotton threads and glass fibers with thin copper wire and had a diameter of 3 mm, was used. In the combustion wick, the burning section and the sucking section were made from the same material and were formed as an integral body.

Figure 5:
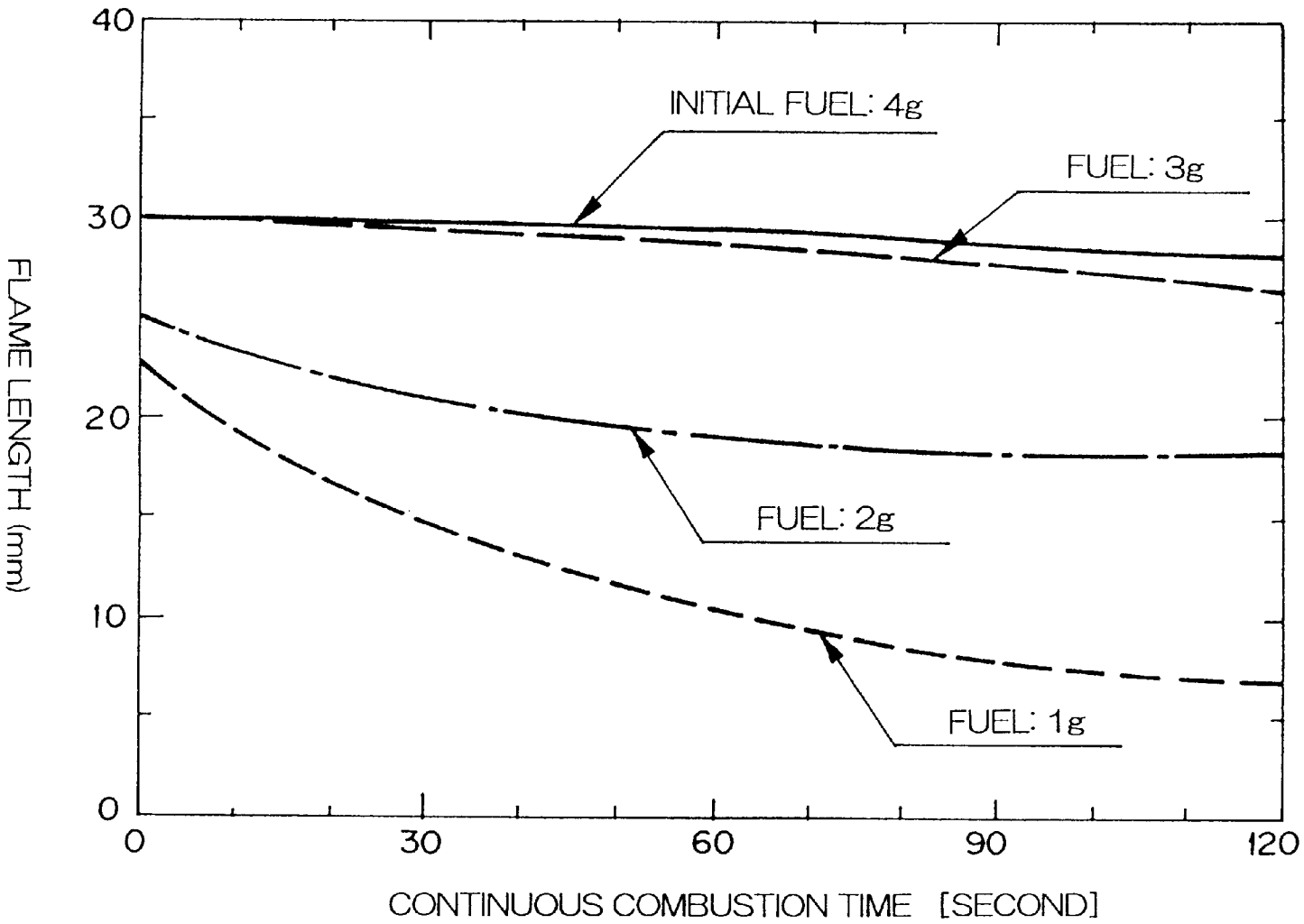
FIG. 5 is a graph showing the results of a combustion test carried out by using a combustion wick of a comparative example with respect to Experimental Example 1.

In the comparative example shown in FIG. 5, the change in flame length accompanying the combustion was affected markedly by the fluctuation in the amount of initial fuel. In cases where the amount of initial fuel was large (4 g or 3 g), the initial flame length could be set at 30 mm, and the fluctuation in flame length with the passage of the combustion time was comparatively small. However, in cases where the amount of initial fuel was small (2 g or 1 g), the initial flame length could not reach 30 mm. Also, when the level of the liquid surface of the fuel became low and the fuel feed distance became large, good sucking performance could not be obtained, and the amount of the fuel fed became insufficient. As a result, the flame length became markedly small with respect to the combustion time. Thus the combustion wick in the comparative example was not suitable for use in a combustion appliance.

On the other hand, as illustrated in FIG. 4, with the combustion wick in accordance with the present invention, good results were obtained clearly. Also, the same good results were obtained with the second embodiment of the combustion wick in accordance with the present invention.

EXPERIMENTAL EXAMPLE 2

The experiments were carried out by using the third embodiment of the combustion wick in accordance with the present invention in order to find a change in flame length with respect to the combustion time.

The basic structure of the lighter used as the combustion appliance was the same as that shown in FIG. 1. Also, the same alcohol fuel (95 wt % ethyl alcohol+5 wt % n-hexane) was used as the liquid fuel. The cross-sectional area of the sucking section of the combustion wick was set to be small.

The combustion wick had the structure illustrated in FIG. 3A. The burning section was made by bundling glass fibers and bending the bundle at its middle part. Specifically, the glass fibers each having a diameter of 6 $\mu$m were bundled such that the fiber density (i.e., the weight per unit area) might be 150 mg/cm$^3$. The bundle of the glass fibers was bent into a bent bundle having an outer diameter of 3 mm and a length of 10 mm. The bent bundle was then inserted into the connecting member, such that the bent bundle might be projected by a length of 5 mm from the top end of the connecting member, and such that an initial flame length might be 30 mm. The sucking section was made by sintering polyethylene powder. Specifically, the powder having the same particle diameter as that described above was sintered under the same temperature conditions. The sucking section did not have the aforesaid head, and the entire sucking section had the same diameter (length: 40 mm).

Experiments were carried out by using two kinds of combustion wicks, in which the diameters of the sucking sections were 3.0 mm and 2.0 mm. In Experimental Example 1 described above, the outer diameter of the sucking section was 4 mm.

Figure 6:
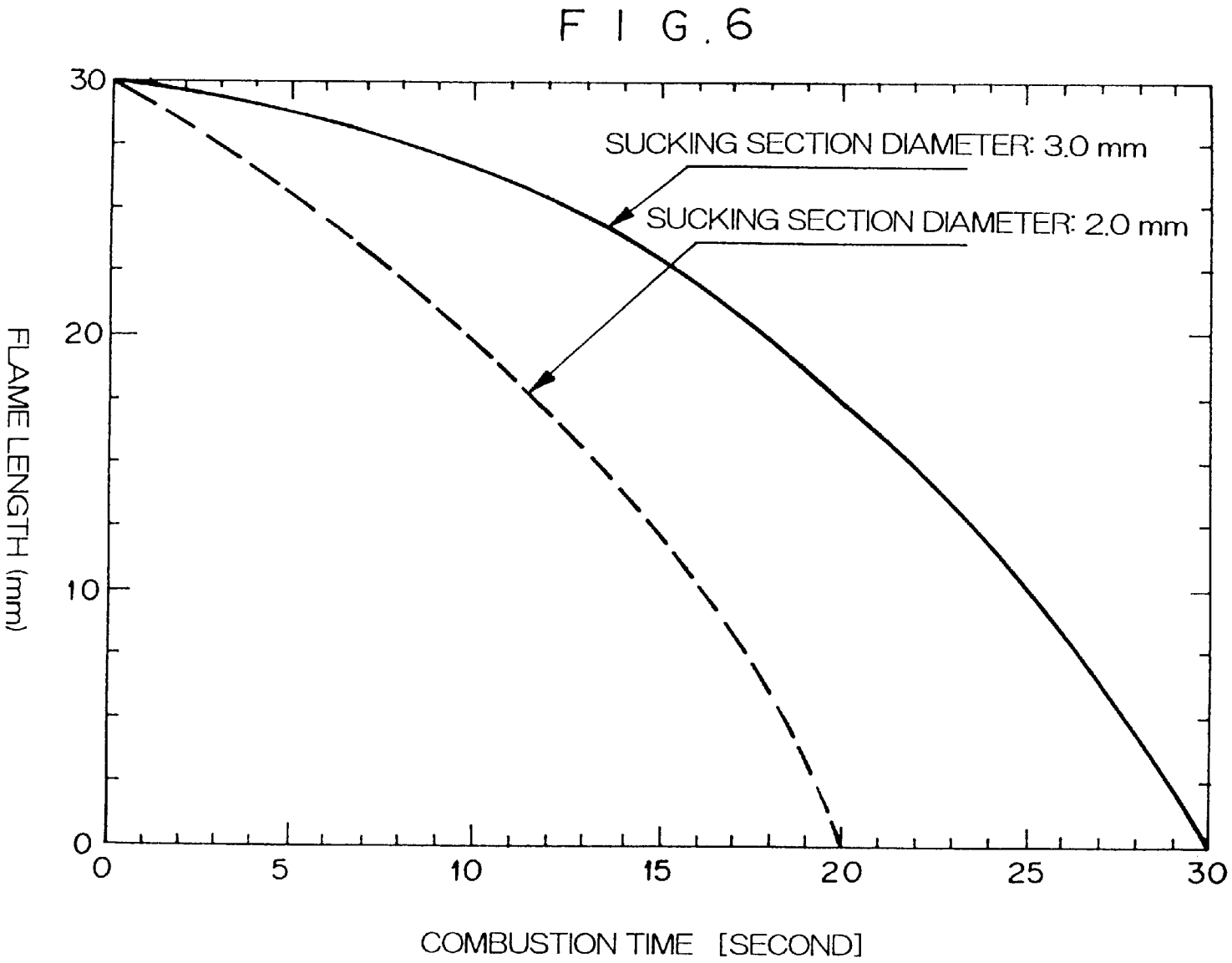
FIG. 6 is a graph showing the results of a combustion test carried out in Experimental Example 2 by incorporating the third embodiment of the combustion wick into the lighter shown in FIG. 1.

The results shown in FIG. 6 were obtained. As illustrated in FIG. 6, the flame length became short with the passage of the combustion time. With the combustion wick having the sucking section, which had the diameter of 3 mm, the characteristics could be obtained such that the fire might go out 30 seconds after the lighting. With the combustion wick having the sucking section, which had the diameter of 2 mm, the characteristics could be obtained such that the fire might go out 20 seconds after the lighting.

For example, in the cases of lighters for smoker's requisites, it is sufficient that the flame length be 20 mm when a length of time of 10 seconds has elapsed after the lighting. Therefore, in the example described above, by the setting of the diameter of the sucking section at 2 mm, a lighter, in which the flame goes out automatically when the combustion has continued for 20 seconds after the lighting, can be constituted.

What is claimed is:

1. A combustion wick in a combustion appliance for a liquid fuel, comprising a sucking section, which sucks up a liquid fuel by the utilization of capillarity, and a burning section for burning the sucked-up liquid fuel, wherein the sucking section and the burning section of the combustion wick are made from different materials and connected to each other, at least one of the sucking section and the burning section having a portion of enlarged cross-section adjacent to the connection between them to provide a fuel reservoir, and wherein the burning section is formed by bundling glass fibers, bending the bundle at its intermediate part, inserting the bent portion of the bundle into a cylindrical connecting member, pushing a wedge-like securing member into the space, which space is defined by the bent portion of the bundle having been inserted into the connecting member, and thereby securing the bent portion of the bundle.

2. A combustion wick in a combustion appliance for a liquid fuel, comprising a sucking section, which sucks up a liquid fuel by the utilization of capillarity, and a burning section for burning the sucked-up liquid fuel, wherein the sucking section and the burning section of the combustion wick are made from different materials and connected to each other, and a rate, at which the liquid fuel is fed through the sucking section to the burning section, is set at a value lower than a fuel burning at the burning section, at least one of the sucking section and the burning section having a portion of enlarged cross-section adjacent to the connection between them to provide a fuel reservoir, and wherein the burning section is formed by bundling glass fibers, bending the bundle at its intermediate part, inserting the bent portion of the bundle into a cylindrical connecting member, pushing a wedge-like securing member into the space, which space is defined by the bent portion of the bundle having been inserted into the connecting member, and thereby securing the bent portion of the bundle.

* * * * *